US008962956B2

(12) United States Patent
Allred, III et al.

(10) Patent No.: US 8,962,956 B2
(45) Date of Patent: Feb. 24, 2015

(54) NECK STIFFENER FOR STRINGED MUSICAL INSTRUMENTS

(75) Inventors: Jimmie B. Allred, III, Skaneateles, NY (US); Michael D. Griswold, Syracuse, NY (US)

(73) Assignee: Allred & Associates Inc., Elbridge, NY (US)

( * ) Notice: Subject to any disclaimer, the term of this patent is extended or adjusted under 35 U.S.C. 154(b) by 357 days.

(21) Appl. No.: 13/446,456

(22) Filed: Apr. 13, 2012

(65) Prior Publication Data

US 2012/0192698 A1 Aug. 2, 2012

Related U.S. Application Data

(63) Continuation-in-part of application No. 13/104,375, filed on May 10, 2011, now Pat. No. 8,800,718, and a continuation-in-part of application No. 12/646,026, filed on Dec. 23, 2009, now Pat. No. 8,448,748.

(60) Provisional application No. 61/474,916, filed on Apr. 13, 2011, provisional application No. 61/535,051, filed on Sep. 15, 2011, provisional application No. 61/333,320, filed on May 11, 2010, provisional application No. 61/350,550, filed on Jun. 2, 2010, provisional application No. 61/373,513, filed on Aug. 13, 2010, provisional application No. 61/141,402, filed on Dec. 30, 2008, provisional application No. 61/151,327, filed on Feb. 10, 2009.

(51) Int. Cl.
*G10D 3/00* (2006.01)
*G10D 3/06* (2006.01)

(52) U.S. Cl.
CPC ..... *G10D 3/06* (2013.01)
USPC ..... 84/293

(58) Field of Classification Search
CPC ..... G10D 3/06; G10D 1/08; G10D 1/00; G10D 1/005; G10D 3/00
USPC ..... 84/267, 290, 293
See application file for complete search history.

(56) References Cited

U.S. PATENT DOCUMENTS

| | | | | |
|---|---|---|---|---|
| 4,084,476 | A * | 4/1978 | Rickard | 84/293 |
| 4,145,948 | A | 3/1979 | Turner | |
| 4,172,405 | A | 10/1979 | Kaman, II | |
| 4,313,362 | A | 2/1982 | Lieber | |
| 4,506,584 | A | 3/1985 | Oakley | |
| 4,557,174 | A | 12/1985 | Gressett, Jr. | |

(Continued)

OTHER PUBLICATIONS

Blackbird Hollow Neck Acoustics, http://acousticguitarforum.tribe.net/thread/f221752b-5fa4-4cd5-83d4-438b8b68b134, 2008.

*Primary Examiner* — Kimberly Lockett
(74) *Attorney, Agent, or Firm* — Brown & Michaels, PC

(57) ABSTRACT

A musical instrument neck stiffener includes a beam fabricated by embedding uni-directional material only at the upper and lower portions of the beam, and constrained by braid or bias weave material. In a preferred embodiment, the uni-directional layers are preferably made from carbon fiber tow, cloth, or pultruded carbon fiber and the braid or bias weave material is made of carbon fibers. To reduce weight, the middle section of the beam is preferably hollow. An angle neck stiffener includes a hollow tube connected to a cradle, which is bonded within an instrument neck. The angle neck stiffener bridges the connection between the instrument neck and a preferably D-shaped neck stiffener.

25 Claims, 17 Drawing Sheets

(56) References Cited

U.S. PATENT DOCUMENTS

| | | | | |
|---|---|---|---|---|
| 4,846,038 | A | 7/1989 | Turner | |
| 4,950,437 | A | 8/1990 | Lieber | |
| 4,951,542 | A | 8/1990 | Chen | |
| 5,895,872 | A | 4/1999 | Chase | |
| 6,100,458 | A | 8/2000 | Carrington et al. | |
| 6,103,961 | A * | 8/2000 | Kaufman | 84/291 |
| 6,259,008 | B1 | 7/2001 | Eddinger et al. | |
| 6,284,957 | B1 | 9/2001 | Leguia | |
| 6,420,638 | B2 | 7/2002 | Teel | |
| 6,774,292 | B2 | 8/2004 | Mace | |
| 6,888,055 | B2 | 5/2005 | Smith et al. | |
| 7,531,729 | B1 | 5/2009 | Davis et al. | |

* cited by examiner

NECK STIFFENER FOR STRINGED MUSICAL INSTRUMENTS

REFERENCE TO RELATED APPLICATIONS

This application claims one or more inventions which were disclosed in Provisional Application No. 61/474,916, entitled "Neck Stiffener for Stringed Musical Instruments", filed Apr. 13, 2011 and Provisional Application No. 61/535,051, entitled "Neck Stiffener for Stringed Musical Instruments", filed Sep. 15, 2011. The benefit under 35 USC §119(e) of the U.S. provisional applications are hereby claimed, and the aforementioned applications are hereby incorporated herein by reference.

This application is also a continuation-in-part application of copending application Ser. No. 13/104,375, filed May 10, 2011, entitled "ULTRA LIGHTWEIGHT SEGMENTED LADDER/BRIDGE SYSTEM", which claims one or more inventions which were disclosed in Provisional Application No. 61/333,320, filed May 11, 2010, entitled "ULTRA LIGHTWEIGHT SEGMENTED LADDER/BRIDGE SYSTEM", Provisional Application No. 61/350,550, filed Jun. 2, 2010, entitled "ULTRA LIGHTWEIGHT SEGMENTED LADDER/BRIDGE SYSTEM" and Provisional Application No. 61/373,513, filed Aug. 13, 2010, entitled "ULTRA LIGHTWEIGHT SEGMENTED LADDER/BRIDGE SYSTEM", and which is a continuation-in-part application of copending application Ser. No. 12/646,026, filed Dec. 23, 2009, entitled "ULTRA LIGHTWEIGHT SEGMENTED LADDER/BRIDGE SYSTEM, which claims one or more inventions which were disclosed in Provisional Application No. 61/141,402, filed Dec. 30, 2008, entitled "DUAL-USE MODULAR CARBON-FIBER LADDER AND BRIDGE" and Provisional Application No. 61/151,327, filed Feb. 10, 2009, entitled "ULTRA LIGHTWEIGHT SEGMENTED LADDER/BRIDGE SYSTEM". The benefit under 35 USC §119(e) of the U.S. provisional applications are hereby claimed, and the aforementioned applications are hereby incorporated herein by reference.

BACKGROUND OF THE INVENTION

1. Field of the Invention

This invention relates to musical instrument neck stiffeners, and in particular to carbon fiber stiffeners embedded within the neck of a guitar or other stringed instrument.

2. Description of Related Art

Neck stiffening rods and beams have been used for many years in guitars, cellos, double basses, banjo, and other similar stringed instruments where the neck, being a relatively long structure, is often weak when compared with the large forces placed on it by the string tension.

Several patents have been issued for instrument neck reinforcing beams. U.S. Pat. No. 4,084,476 (Rickard) discloses a rectangular or I-beam neck stiffening member that includes wood, plastic, metal, or carbon fiber, and is embedded within the instrument neck adjacent to the forward surface of the neck body and concealed by a fingerboard.

U.S. Pat. No. 4,313,362 (Lieber) also discloses an aluminum hollow reinforcement embedded within the neck of a guitar.

U.S. Pat. No. 6,888,055 (Smith) discloses a solid instrument support rod constructed of a high stiffness material, such as carbon fiber, wrapped around a lower density core material.

U.S. Pat. No. 4,145,948 (Turner), U.S. Pat. No. 4,846,038 (Turner), U.S. Pat. No. 4,950,437 (Lieber), U.S. Pat. No. 5,895,872 (Chase), and U.S. Pat. No. 4,951,542 (Chen), also disclose carbon fiber or other fiber reinforced plastic composite instrument necks or neck reinforcements.

SUMMARY OF THE INVENTION

A musical instrument neck stiffener includes a beam including a hollow composite tube. The tube includes tube walls that are made of at least one layer of uni-directional composite material encapsulated by at least one outer layer of non uni-directional composite material. In some preferred embodiments, the neck stiffener beam is made of carbon fiber. In other preferred embodiments, the neck stiffener beam is made of fiberglass or aramid fibers. The neck stiffener may also include an angle neck stiffener, which includes a tubular end and a cradle end. The angle neck stiffener is preferably made from carbon fiber. The tubular end of the angle neck stiffener extends into the neck and the cradle end of the angle neck stiffener is attached to the neck stiffener beam.

DETAILED DESCRIPTION OF THE INVENTION

There is an ongoing need to find improved ways to support the neck of stringed instruments. In particular, guitars, cellos, double basses, and banjos, require additional stiffening embedded within the neck of the instrument to improve bending and torsional rigidity. Although carbon fiber rods have been used for this application, the methods and devices disclosed herein improve upon the known methods and allow easy fitting and placement of the reinforcement below the fingerboard.

A "composite material", as defined herein, is a material made from two or more different materials with different physical or chemical properties, which remain separate and distinct at the macroscopic or microscopic scale within the resulting material. One example of a composite material is a material with fibers embedded into a matrix (fibrous composites), which include uni-directional composite materials (i.e. all fibers oriented in a single direction), and non uni-directional composite materials (i.e. fibers oriented in multiple or off-axis directions). Other examples of composite materials are particulate composites, flake composites, and filler composites. Fibrous composite materials are preferably used in the embodiments of the present invention.

Figure 1:
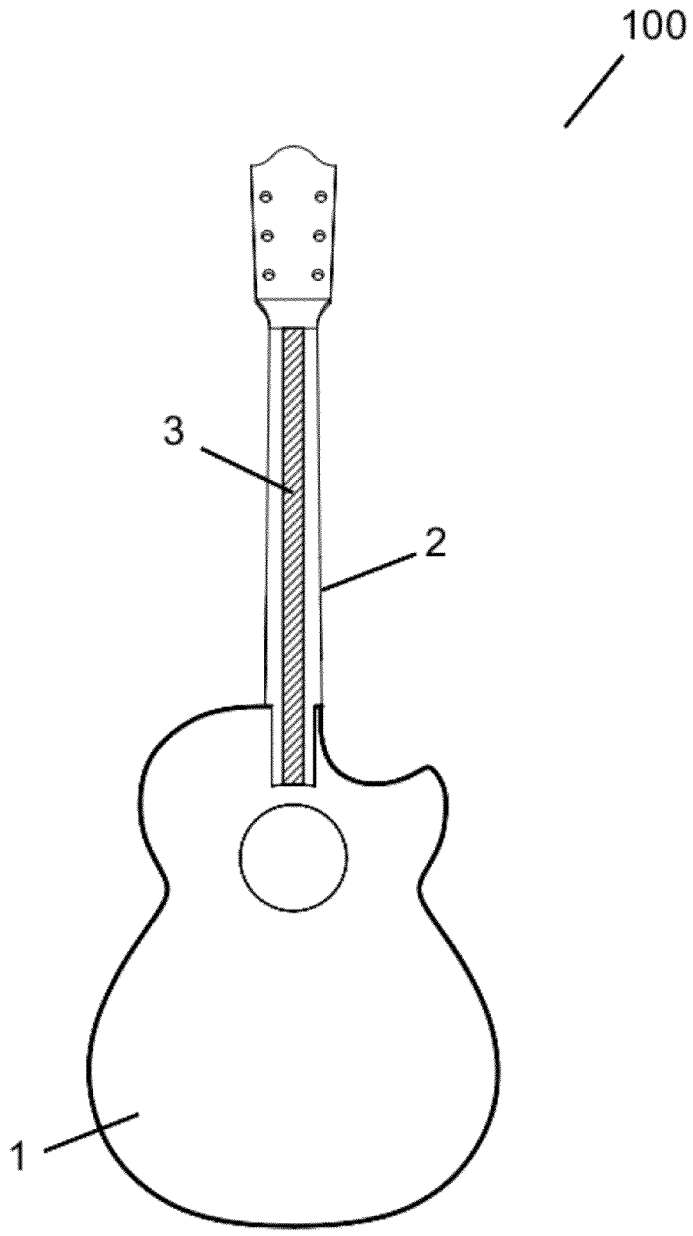
FIG. 1 shows an embodiment of a neck stiffener beam embedded within the neck of a guitar with the fingerboard removed.

FIG. 1 shows a guitar 100 with a main body 1 and a neck 2. A neck stiffener beam 3 is embedded within the neck 2 of the instrument. The neck stiffener beam 3 is designed to sit in a groove or channel formed in the instrument neck 2, for example cut in the instrument neck 2 by a router tool. Instrument builders and repair people may utilize the neck stiffener beam 3 as a stiffening member for the neck 2 (which is typically made of wood), both in bending and torsion.

In preferred embodiments, the neck stiffener beam 3 includes a hollow composite tube. The tube includes tube walls that are made of at least one layer of uni-directional composite material encapsulated by at least one outer layer of non uni-directional composite material. In some preferred embodiments, the neck stiffener beam 3 is made of fibrous composites. In some preferred embodiments, the fibrous composites include carbon fiber. In other preferred embodiments, the fibrous composites of the neck stiffener beam 3 are made of fiberglass or aramid fibers. In still other embodiments, the neck stiffener beam 3 is made of any combination of carbon fiber, fiberglass, and aramid fibers.

Figure 2:
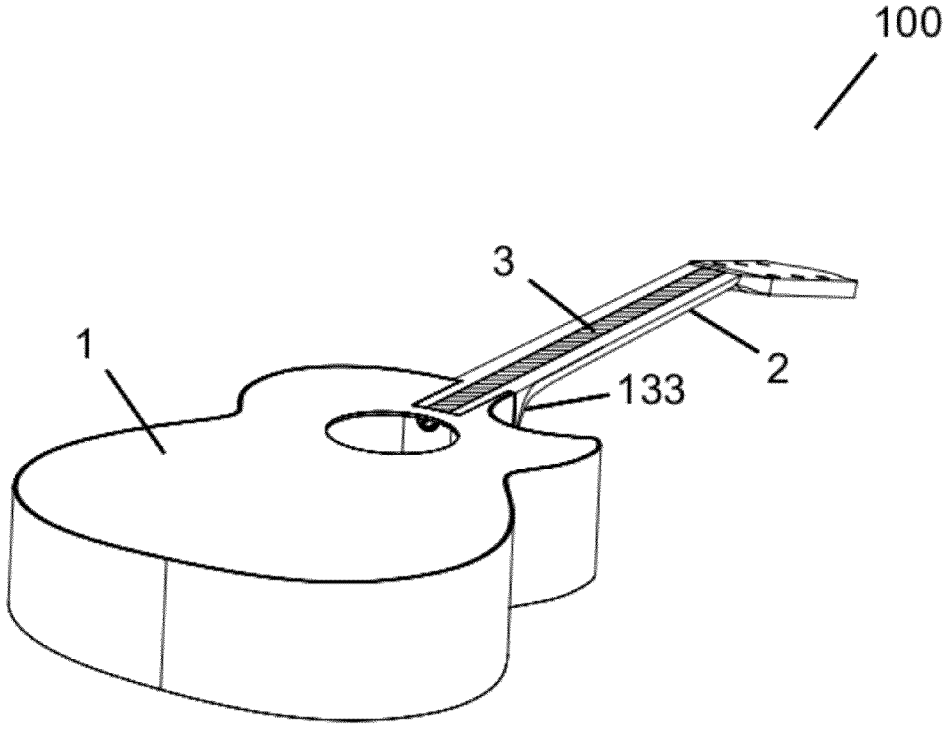
FIG. 2 shows an alternative view of the guitar shown in FIG. 1.

FIG. 2 shows an alternative view of the guitar 100 shown in FIG. 1. The neck stiffener beam 3 preferably runs the length of the guitar neck 2 and has a rectangular (see, for example, FIG. 9) or D-shaped (see, for example, FIGS. 3-8) cross-section. An angled neck extension 133 provides additional bending support to the neck 2. The embodiments described herein differ from the prior art in that the beam is composed of multiple layers of carbon fiber or other composite material, with the fiber direction optimized for maximum stiffness and minimum weight.

The reduced weight of this beam 3 improves the balance of the guitar, making it easier to play. The increased stiffness to weight ratio of the neck 2 with this reinforcing beam 3 installed improves the acoustics of the instrument by raising the natural resonant frequency of the neck 2, reducing any interference of the neck 2 with resonance of the body 1, strings, and enclosed air mass.

The neck stiffener beams described herein provide the highest possible torsional stiffness to mass ratio by positioning the bias or braid plies around the outside of the beam as far as possible from the centerline. It also provides the greatest bending stiffness to mass ratio by utilizing uni-directional fibers placed as far as possible from the neutral axis. The resulting torsional and bending stiffness to weight ratios are significantly greater than can be achieved with a solid carbon fiber section, a section with a lightweight core material, or a hollow tube made solely of one material or fiber orientation.

Figure 3:
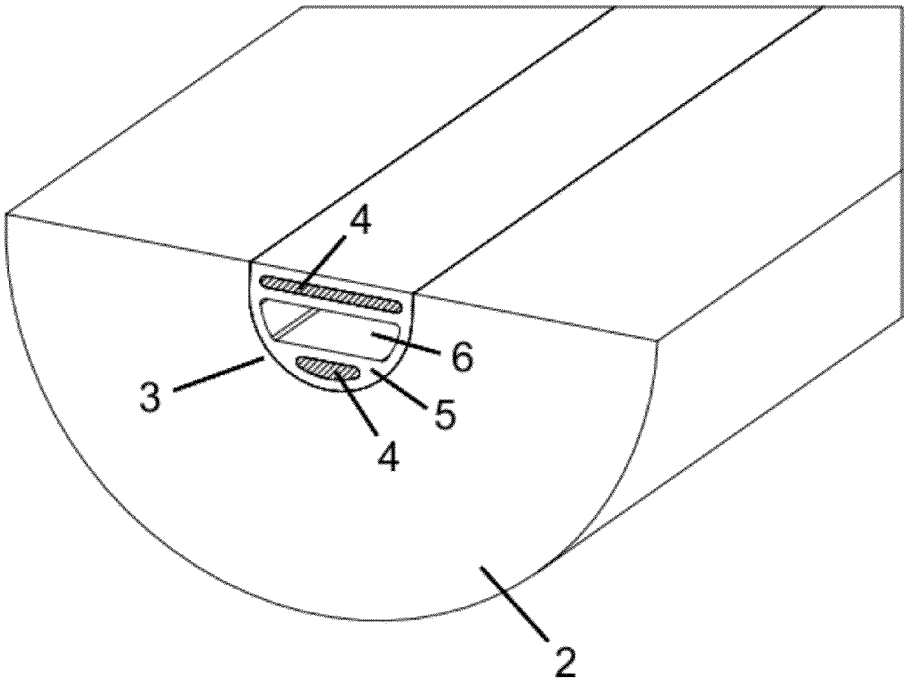
FIG. 3 shows a close-up view of the neck stiffener beam in an embodiment of the present invention.
Figure 4:
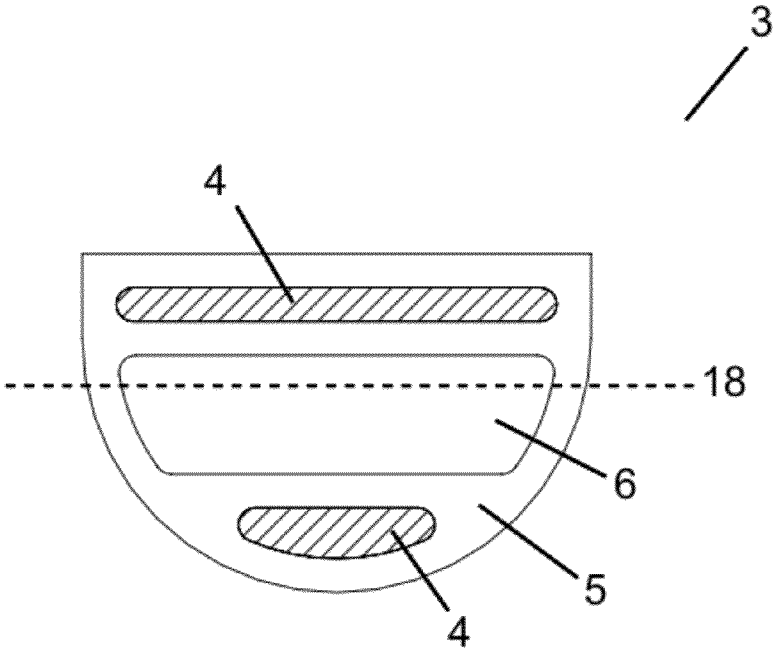
FIG. 4 shows a carbon fiber layout for the neck stiffener beam shown in FIG. 3.

A close-up of one embodiment of the neck stiffener beam 3 embedded within the guitar neck 2 is shown in FIGS. 3 and 4. In this embodiment, the beam 3 is fabricated by embedding uni-directional carbon fiber 4 only at the upper and lower portions of the beam, and constrained by braid or bias weave material 5. FIG. 4 shows a neck stiffener beam 3 with two flat uni-directional layers 4. In embodiments where the beam 3 is made of carbon fiber, the uni-directional carbon fiber layers 4 are preferably made from carbon fiber tow, cloth, or pultruded carbon fiber and the braid or bias weave layers 5 are made of braid or bias weave carbon fiber. To reduce weight, the middle section 6 of the beam 3 is preferably hollow.

Figure 5:
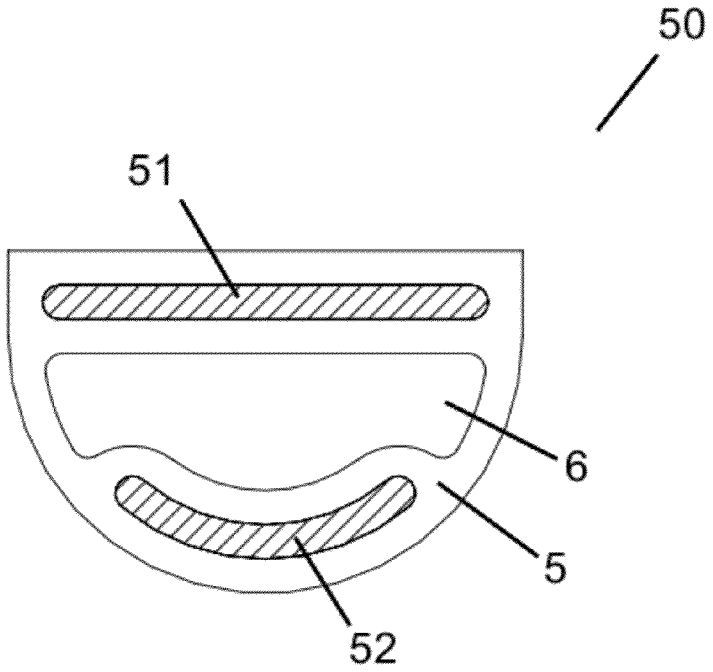
FIG. 5 shows an alternative layout for the beam shown in FIG. 3.

FIGS. 5-8 show embodiments with alternative geometries for the uni-directional 4 and braided layers 5 of the beam. FIG. 5 shows a neck stiffener beam 50 with one flat uni-directional layer 51 and one curved uni-directional layer 52. In embodiments using carbon fiber, the uni-directional carbon fiber layers 51 and 52 are preferably made from carbon fiber tow, cloth, or pultruded carbon fiber and the braid or bias weave layers 5 are made of braid or bias weave carbon fiber. The altered shape of the second uni-directional layer 52 changes the shape of the braid or bias weave layer 5 and the hollow space 6 compared to the embodiment shown in FIG. 4. Note, however, that the hollow space 6 may still have the same general shape as shown in FIG. 4, if the braided layers 5 are designed to not follow the curve of the uni-directional layer 52.

Figure 6:
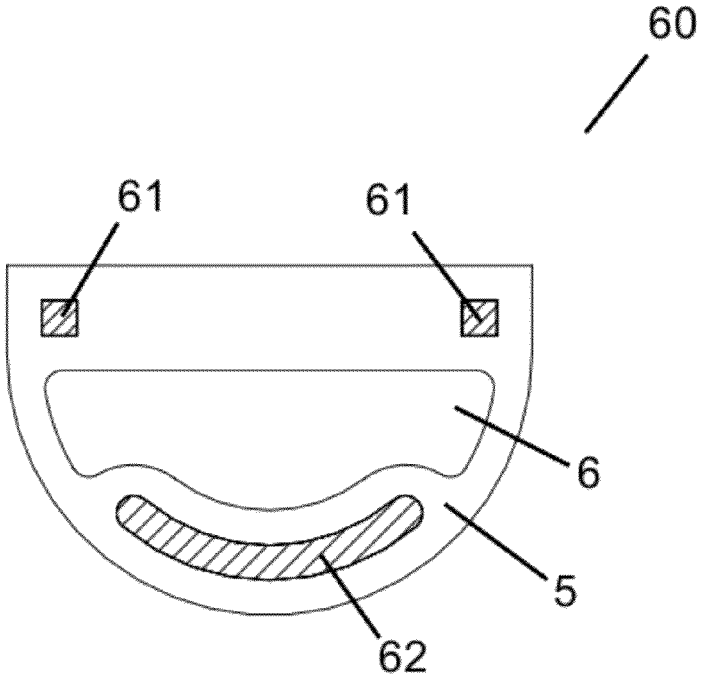
FIG. 6 shows another alternative layout for the beam shown in FIG. 3.

FIG. 6 shows a carbon fiber beam 60 with two small square uni-directional rods 61 and one curved uni-directional layer 62. In embodiments using carbon fiber, the uni-directional layers 61 and 62 are preferably made from carbon fiber tow, cloth, or pultruded carbon fiber and the braid or bias weave layers 5 are made of braid or bias weave carbon fiber. The altered shape of the second uni-directional layer 62 changes the shape of the braid or bias weave layers 5 and the hollow space 6 compared to the embodiment shown in FIG. 4. Note, however, that the hollow space 6 may still have the same general shape as shown in FIG. 4, if the braided layers 5 are designed to not follow the curve of the uni-directional layer 62.

Figure 7:
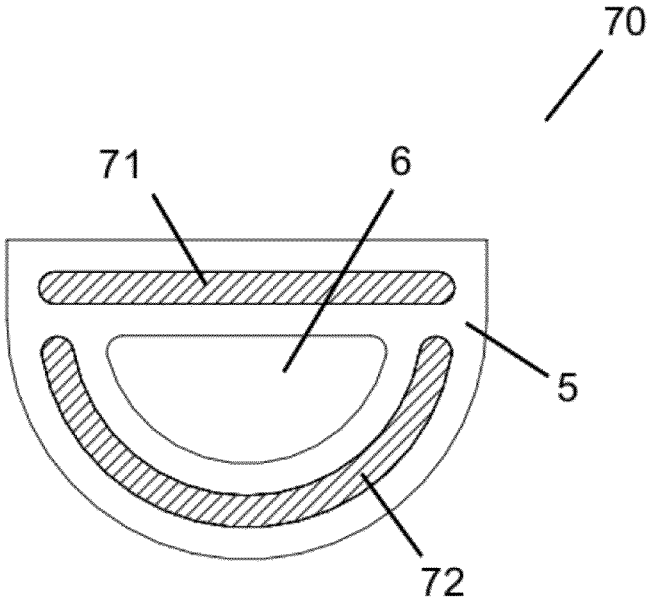
FIG. 7 shows another alternative layout for the beam shown in FIG. 3.

FIG. 7 shows an alternative neck stiffener beam 70 with one flat uni-directional layer 71 and one curved uni-directional layer 72. In embodiments using carbon fiber, the uni-directional carbon fiber layers 71 and 72 are preferably made from carbon fiber tow, cloth, or pultruded carbon fiber and the braid or bias weave layers 5 are made of braid or bias weave carbon fiber. The altered shape of the second uni-directional layer 71 changes the shape of the braid or bias weave layers 5 and the hollow space 6 compared to the embodiment shown in the previous figures.

Figure 8:
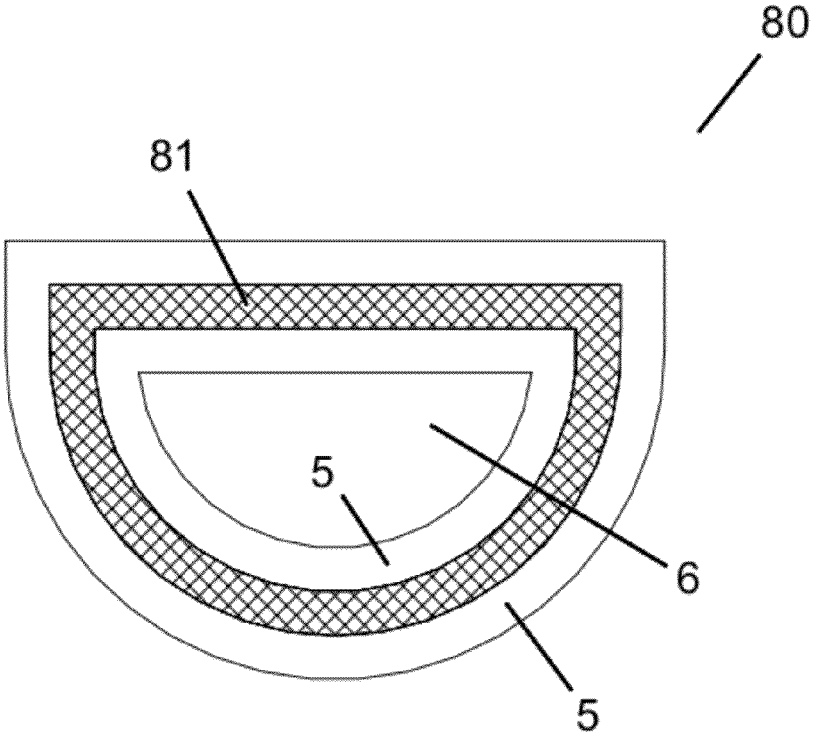
FIG. 8 shows another alternative beam layout with uni-directional material placed around the entire perimeter of the cross-section.

FIG. 8 shows a neck stiffener beam 80 with a continuous D-shaped uni-directional layer 81 sandwiched between two layers of D-shaped bias or braided material 5. Here, the cross-section can be of constant or non-constant wall thickness. In embodiments with carbon fiber, the uni-directional carbon fiber layer 81 is preferably made from carbon fiber tow, cloth, or pultruded carbon fiber and the bias or braided layers 5 are made of bias or braided carbon fiber.

FIGS. 3-8 are shown as examples of guitar neck stiffeners with a D-shaped cross-section including at least one uni-directional layer, at least one bias or braided layer, and a hollow portion. Other embodiments with other shapes for these layers are within the spirit of the present invention. In some embodiments, the carbon fiber could be replaced with fiberglass or aramid fibers in order to further tailor the stiffness and structural damping.

Figure 9:
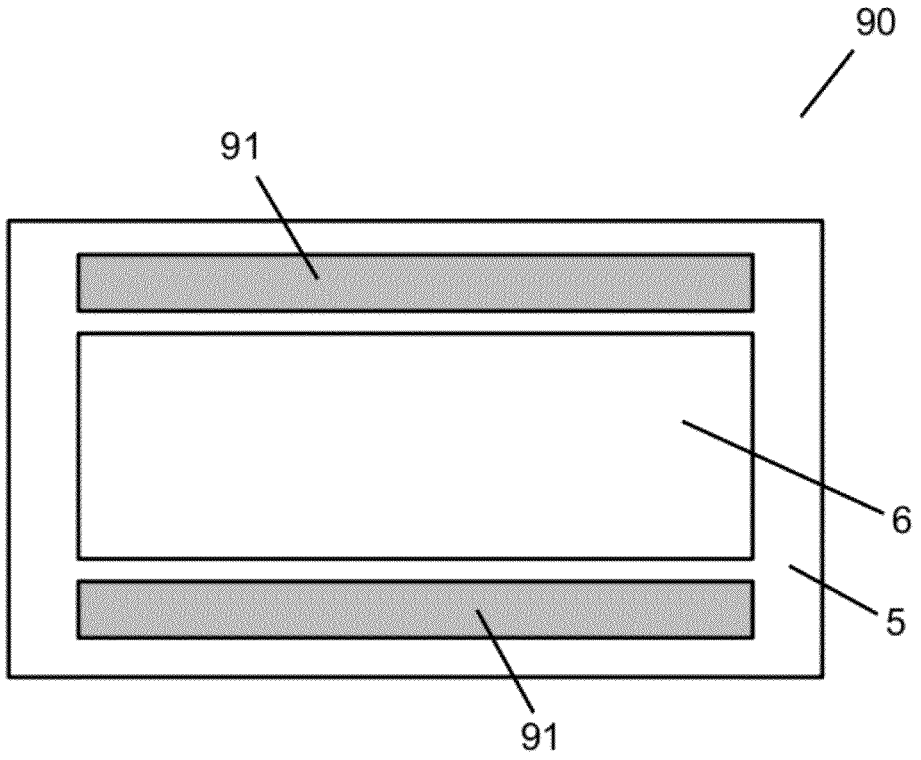
FIG. 9 shows a rectangular geometry of the beam in an alternative embodiment of the present invention.

FIG. 9 shows a rectangular neck stiffener 90 in another embodiment of the present invention. In FIG. 9, two flat uni-directional layers 91 are sandwiched between layers of bias or braided material 5. In a preferred embodiment, the flat uni-directional layers 91 are made of uni-directional carbon fiber and the bias or braided material 5 is carbon fiber. Alternatively, the carbon fiber could be replaced with fiberglass or aramid fibers in order to further tailor the stiffness and structural damping. The neck stiffener 90 also includes a hollow portion 6. Other rectangular neck stiffeners with other shapes for the uni-directional layers 91, the bias or braided material, and the hollow portion 6 are within the spirit of the present invention. For example, in one alternative embodiment, the top uni-directional layer 91 and/or the bottom uni-directional layer 91 could be replaced with two or more square uni-directional layers, similar to the uni-directional rods 61 shown in FIG. 6.

Figure 10:
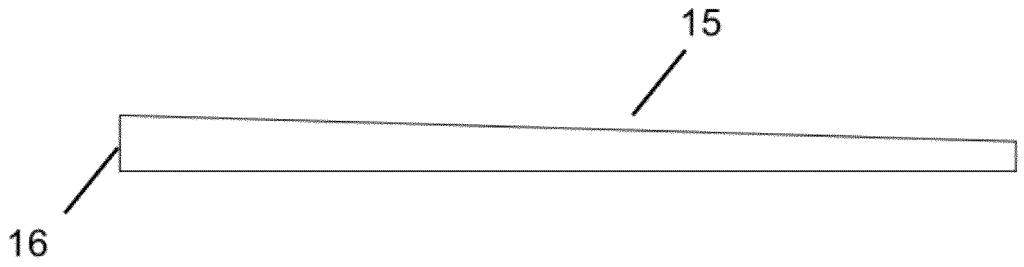
FIG. 10 shows a side view of a height tapered beam in an embodiment of the present invention.

An alternative geometry for the neck stiffener 15 is shown in FIG. 10 where the height 16 is tapered along its length. This tapered geometry could be used for any of the guitar neck stiffeners 3, 50, 60, 70, 89 and 90 described herein. Spanwise reduction of the height 16 of the guitar neck stiffener provides an improved fit within certain thin instrument necks.

Figure 11A:
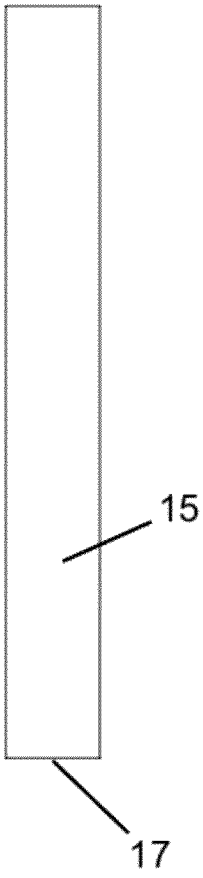
FIG. 11*a* shows an alternative view of the carbon fiber beam shown in FIG. 10.
Figure 11B:
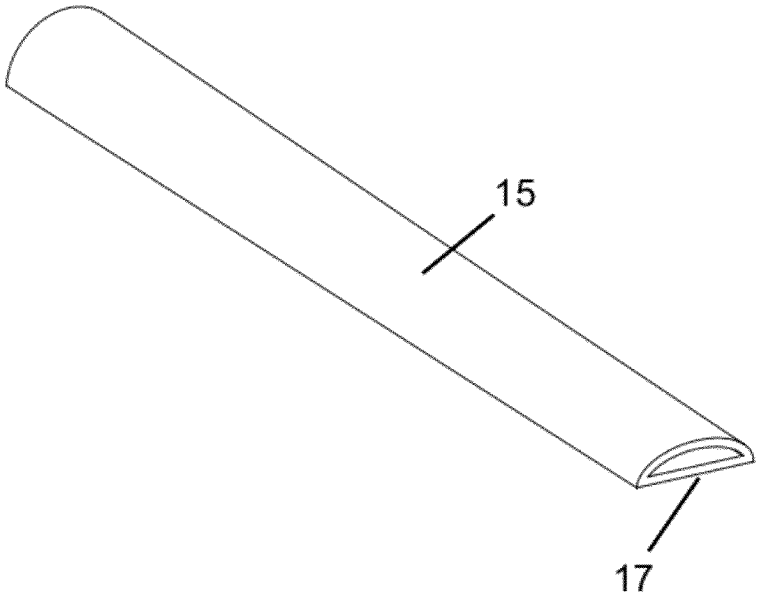
FIG. 11*b* shows another alternative view of the beam shown in FIG. 10.
Figure 12:
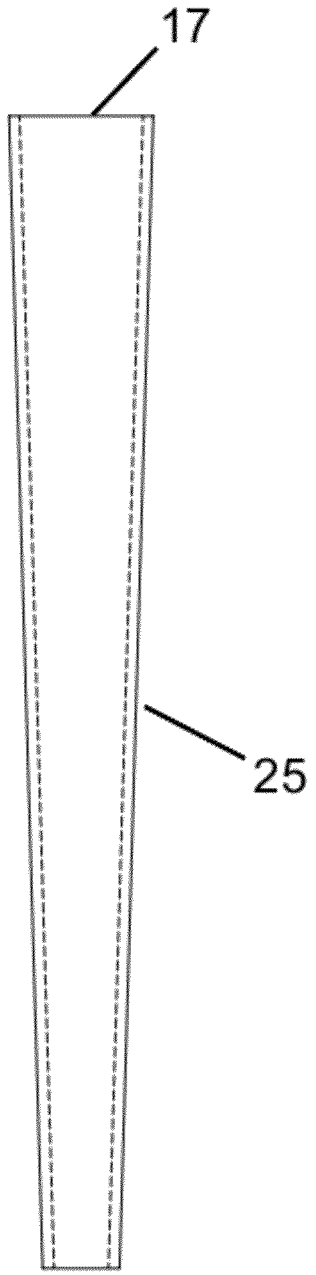
FIG. 12 shows a top view of a height and width tapered beam of the present invention.

FIGS. 11*a* and 11*b* show alternative views of the tapered height beam 15. In FIGS. 10 and 11, the width 17 of the beam 15 remains constant. Alternatively, the width 17 of the beam 25 can be tapered instead of or in addition to the height 16 taper, as shown in FIG. 12.

The hollow construction of the neck stiffener combined with the placement of the uni-directional material as far as possible from the neutral axis 18 (see FIG. 4) results in a reinforcing beam that is extremely lightweight, yet rigid in all three critical modes: axial, bending, and torsion. While the neutral axis 18 is shown in a particular location with respect to the embodiment of FIG. 4, the location of the neutral axis 18 depends on the cross-sectional shape of the neck stiffener beam.

Figure 13:
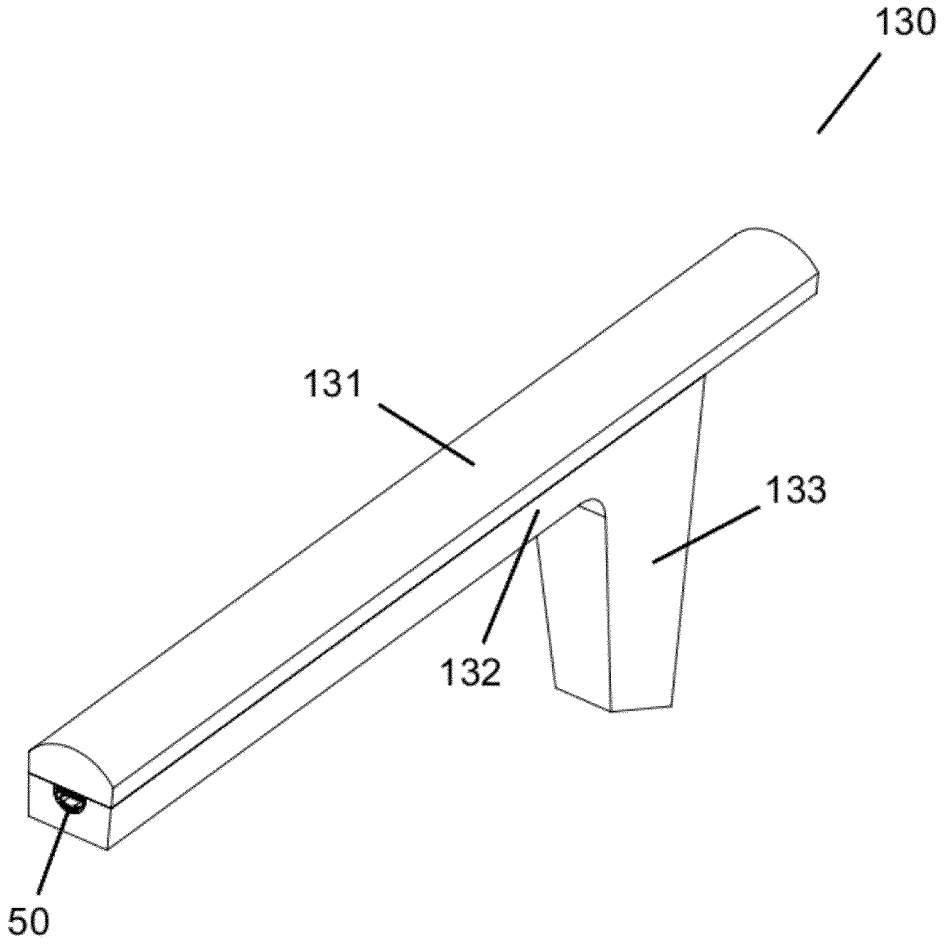
FIG. 13 shows a guitar neck and fingerboard with a guitar neck stiffener in an embodiment of the present invention.
Figure 14A:
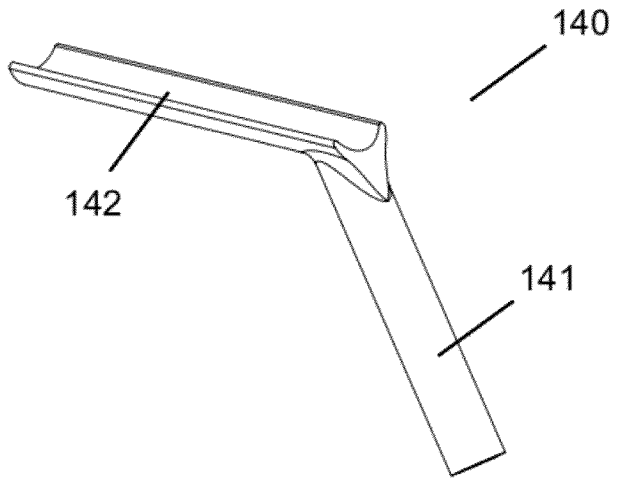
FIG. 14*a* shows a guitar angle neck stiffener in an embodiment of the present invention.
Figure 14B:
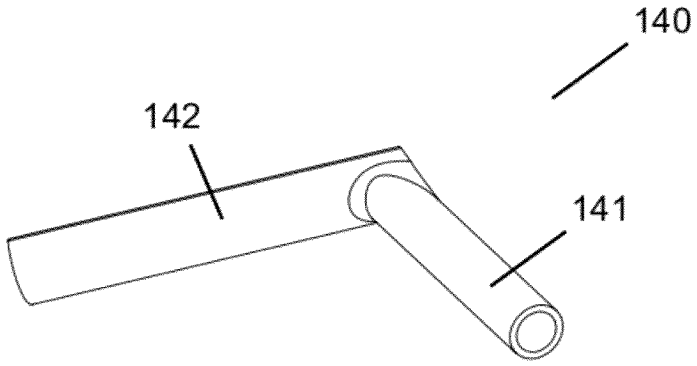
FIG. 14*b* shows an alternative view of the guitar angle neck stiffener shown in FIG. 14*a*.

FIG. 13 shows a guitar neck assembly 130 including a fingerboard (or fretboard) 131, a neck 132, and a neck stiffener beam 50. The neck 132 includes an angled neck extension 133 that abuts the body 1 of the guitar 100 (see FIG. 2). In a preferred embodiment, the neck stiffener beam 50 is made of carbon fiber. In addition to the neck stiffener beam 50, an angle neck stiffener 140, as shown in FIGS. 14*a* and 14*b*, may also be included. The angle neck stiffener 140 includes a tubular end 141 and a cradle end 142, both preferably made from carbon fiber.

Figure 15:
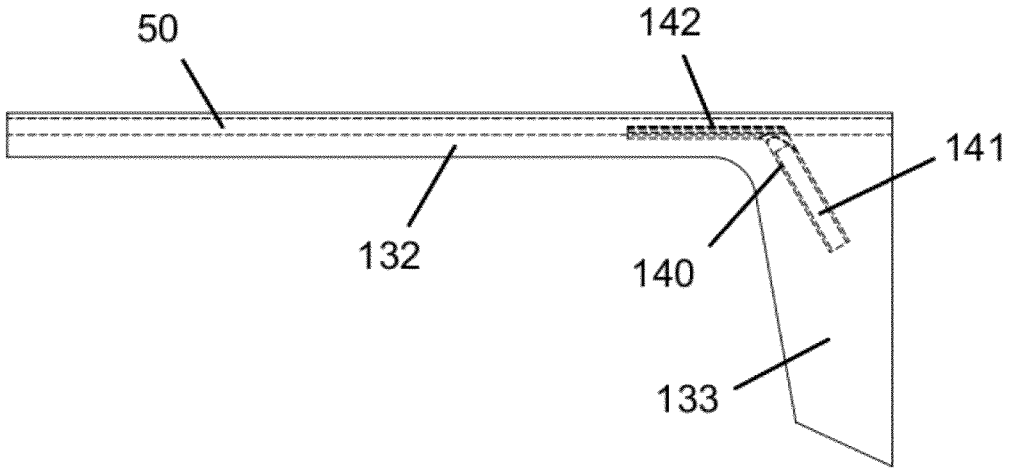
FIG. 15 shows an embodiment of a guitar angle neck stiffener embedded within a guitar neck.
Figure 16:
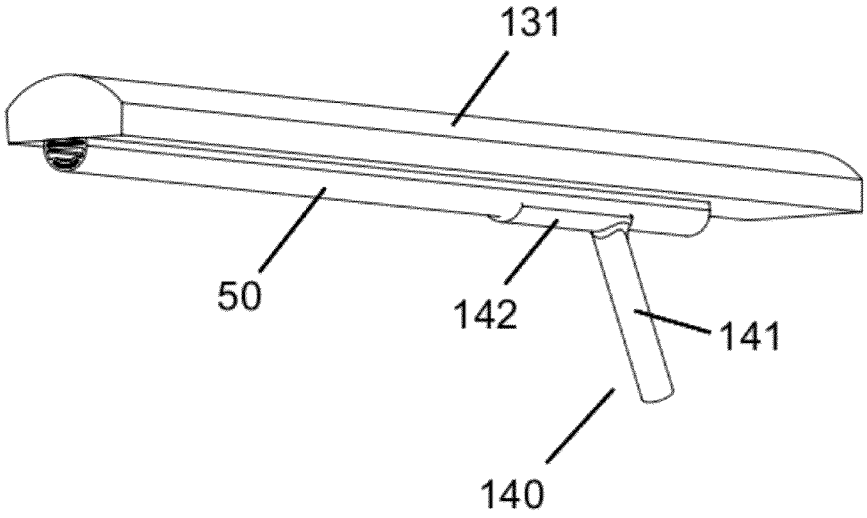
FIG. 16 shows an embodiment of an angle neck stiffener and neck stiffener beam underneath a guitar fingerboard.

FIG. 15 shows the angle neck stiffener 140 embedded within an instrument neck 132. The tubular end 141 of the angle neck stiffener 140 extends into the angled neck extension 133 and is attached to the neck 132 with adhesive, preferably epoxy. The cradle end 142 of the angle neck stiffener is glued to the neck stiffener beam 50, as shown in FIG. 16. The fingerboard 131 is then glued to the neck stiffener beam 50 to complete the assembly. The angle neck stiffener bridges the connection between the instrument neck and the neck stiffener. In embodiments where the beam has a D-shaped cross-section, the cradle includes a channel shaped to fit the D-shape of the beam. While the neck stiffener beam 50 from FIG. 5 is shown in this embodiment, any of the neck stiffener beams discussed in FIGS. 3-12 could be used in combination with the angle neck stiffener 140. If the angle neck stiffener 140 is used in combination with a rectangular beam, for example like the beam 90 shown in FIG. 9, the cradle 142 would have a flat top instead of a channel to accommodate the rectangular shape. Alternatively, the cradle 142 could have a rectangular shaped channel that the beam shape would fit into. In preferred embodiments, the angle neck stiffener 140 is made of carbon fiber. In other embodiments, other materials, including, but not limited to, fiberglass, aramid, aluminum, steel, titanium, or plastic, could be used to make the angle neck stiffener 140.

Figure 17:
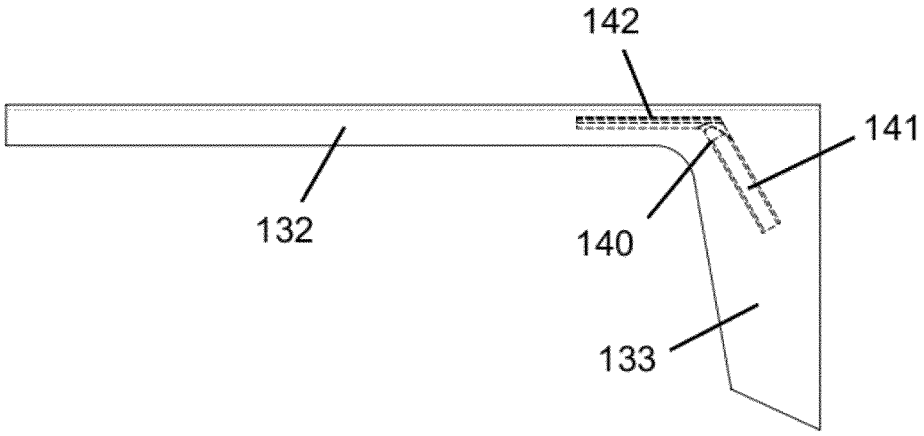
FIG. 17 shows an embodiment of an angle neck stiffener in a neck of a guitar.

The angle neck stiffener 140 may alternatively be used alone in the neck 132 of a musical instrument, as shown in FIG. 17. In this alternative embodiment, a channel to accommodate the cradle 142 of the angle neck stiffener 140 is made in the horizontal portion of the instrument neck 132. In one preferred embodiment, a channel is bored into the neck 132 with a router. A hole, into which the tubular end 141 of the angle neck stiffener 140 will fit, is bored from the channel down into the angled neck extension 133. The angle neck stiffener 140 in these embodiments is preferably made of carbon fiber. In other embodiments, other materials, including, but not limited to, fiberglass, aramid, aluminum, steel, titanium, or plastic, could be used to make the angle neck stiffener 140.

Although a guitar is shown in the figures, the instrument neck stiffeners (including the neck stiffener beams and the angle neck stiffener) described herein could alternatively be used for any stringed instrument, including, but not limited to, guitars, cellos, double basses, and banjos.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A musical instrument comprising:

a) an instrument body;

b) an instrument neck extending from the instrument body; and c) an instrument neck stiffener beam embedded within a channel in the instrument neck, comprising a first hollow composite tube comprising a tube wall, wherein the tube wall comprises at least one layer of uni-directional composite material encapsulated by at least one outer layer of non uni-directional composite material.

2. The musical instrument of claim 1, wherein the uni-directional composite material is also encapsulated by at least one inner layer of non uni-directional composite material.

3. The musical instrument of claim 1, wherein the first hollow composite tube is D-shaped.

4. The musical instrument of claim 1, wherein the first hollow composite tube is rectangular in shape.

5. The musical instrument of claim 1, wherein the first hollow composite tube is sized to run an entire length of the instrument neck.

6. The musical instrument of claim 1, wherein the uni-directional composite material is selected from the group consisting of fiberglass, aramid, carbon fiber, and any combination of fiberglass, aramid, and carbon fiber.

7. The musical instrument of claim 1, wherein the non uni-directional composite material is selected from the group consisting of fiberglass, aramid, carbon fiber, and any combination of fiberglass, aramid, and carbon fiber.

8. The musical instrument of claim 1, wherein the uni-directional composite material forms a continuous layer within the first hollow composite tube.

9. The musical instrument of claim 1, wherein the uni-directional composite material is only placed along two parallel sides of the first hollow composite tube.

10. The musical instrument of claim 1, wherein a height of the first hollow composite tube tapers along its length.

11. The musical instrument of claim 1, wherein a width of the first hollow composite tube tapers along its length.

12. The musical instrument of claim 1, further comprising an angle neck stiffener comprising:

a second hollow tube; and a cradle;

wherein one end of the second hollow tube is connected to one end of the cradle;

wherein the second hollow tube and cradle are aligned such that they are not co-linear;

wherein the cradle is attached to a bottom of the hollow composite tube of the instrument neck stiffener beam; and wherein the second hollow tube extends downward into an angled neck extension of the instrument neck.

13. The musical instrument of claim 12, wherein a material used to make the second hollow tube and the cradle is selected from the group consisting of fiberglass, aramid, carbon fiber, aluminum, steel, titanium, plastic, and any combination of fiberglass, aramid, carbon fiber, aluminum, steel, titanium, and plastic.

14. A method of fabricating a composite instrument neck stiffener beam, comprising the steps of:

a) sandwiching a plurality of uni-directional carbon-fiber strips within a carbon-fiber tube between an inner carbon fiber layer of the carbon fiber tube and an outer carbon fiber layer of the carbon fiber tube;

b) adhering the uni-directional carbon-fiber strips to the carbon fiber tube; and c) embedding the composite neck stiffener beam into a channel formed in a neck of a musical instrument.

15. A musical instrument comprising:

a) an instrument body;

b) an instrument neck extending from the instrument body; and c) an instrument neck stiffener beam embedded within a channel in the instrument neck, comprising a first hollow composite tube having a D-shaped cross-section and comprising a tube wall, wherein the tube wall comprises at least one layer of uni-directional composite material encapsulated by at least one outer layer of non uni-directional composite material; and d) an angle neck stiffener comprising a second hollow tube and a cradle;

wherein one end of the second hollow tube is connected to one end of the cradle;

wherein the second hollow tube and cradle are aligned such that they are not co-linear;

wherein the cradle is attached to a bottom of the first hollow composite tube of the instrument neck stiffener beam; and wherein the second hollow tube extends downward into an angled neck extension of the instrument neck.

16. The musical instrument of claim 15, wherein the uni-directional composite material is also encapsulated by at least one inner layer of non uni-directional composite material.

17. The musical instrument of claim 15, wherein the first hollow composite tube is sized to run an entire length of the instrument neck.

18. The musical instrument of claim 15, wherein the uni-directional composite material is selected from the group consisting of fiberglass, aramid, carbon fiber, and any combination of fiberglass, aramid, and carbon fiber.

19. The musical instrument of claim 15, wherein the non uni-directional composite material is selected from the group consisting of fiberglass, aramid, carbon fiber, and any combination of fiberglass, aramid, and carbon fiber.

20. The musical instrument of claim 15, wherein the uni-directional composite material forms a continuous layer within the first hollow composite tube.

21. The musical instrument of claim 15, wherein the uni-directional composite material is only placed along two parallel sides of the first hollow composite tube.

22. The musical instrument of claim 15, wherein a height of the first hollow composite tube tapers along its length.

23. The musical instrument of claim 15, wherein a width of the first hollow composite tube tapers along its length.

24. A musical instrument comprising:

a) an instrument body;

b) an instrument neck extending from the instrument body and comprising a horizontal neck section and an angled neck extension extending downward from the horizontal neck section; and c) an angled neck stiffener comprising:

a hollow tube extending downward into the angled neck extension of the instrument neck; and a cradle embedded within a channel in the horizontal section of the instrument neck;

wherein one end of the hollow tube is connected to one end of the cradle; and wherein the hollow tube and cradle are aligned such that they are not co-linear.

25. The musical instrument of claim 24, wherein a material used to make the hollow tube and the cradle is selected from the group consisting of fiberglass, aramid, carbon fiber, aluminum, steel, titanium, plastic, and any combination of fiberglass, aramid, carbon fiber, aluminum, steel, titanium, and plastic.

* * * * *